US007178674B2

(12) United States Patent
Krumme

(10) Patent No.: US 7,178,674 B2
(45) Date of Patent: Feb. 20, 2007

(54) CONTAINER COMPRISING A SLIDE COVER

(75) Inventor: Markus Krumme, Randolph, NJ (US)

(73) Assignee: LTS Lohmann Therapie Systeme AG, Andernach (DE)

( * ) Notice: Subject to any disclaimer, the term of this patent is extended or adjusted under 35 U.S.C. 154(b) by 25 days.

(21) Appl. No.: 10/488,226

(22) PCT Filed: Aug. 13, 2002

(86) PCT No.: PCT/EP02/09059

§ 371 (c)(1),
(2), (4) Date: Mar. 1, 2004

(87) PCT Pub. No.: WO03/020606

PCT Pub. Date: Mar. 13, 2003

(65) Prior Publication Data

US 2004/0188317 A1 Sep. 30, 2004

(30) Foreign Application Priority Data

Sep. 3, 2001 (DE) ..... 101 43 120

(51) Int. Cl.
*B65D 1/34* (2006.01)

(52) U.S. Cl. ..... 206/555; 206/1.5; 220/345.2

(58) Field of Classification Search ..... 206/1.5, 206/528, 536, 538, 555; 220/345.2, 345.3, 220/351

See application file for complete search history.

(56) References Cited

U.S. PATENT DOCUMENTS 3,049,224 A * 8/1962 Fredette et al. ..... 206/532
3,833,143 A * 9/1974 Starkermann et al. ..... 220/351
3,888,350 A 6/1975 Horvath
3,987,891 A 10/1976 Horvath
4,126,224 A * 11/1978 Laauwe et al. ..... 206/540
5,012,922 A 5/1991 Nehl (Continued)

FOREIGN PATENT DOCUMENTS

DE 538608 11/1933

(Continued)

*Primary Examiner*—David T. Fidei
(74) *Attorney, Agent, or Firm*—Frommer Lawrence & Haug LLP

(57) ABSTRACT

The invention relates to a container for storing and providing stacked film-like or sheet-like materials. The container is comprised of a pan, which accommodates the stacked materials and has a bottom and closed lateral walls joined thereto, and of a tightly sealing cover that at least partially encloses said pan. To this end, the cover is provided in the form of a slide cover. Both sides of the pan and of the slide cover are provided, parallel to their longitudinal direction, with parallel guide elements. All lateral walls of the pan have, up to the slide cover, a closed pan sealing surface that encircles the pan opening. The slide cover encompasses, at least in part or in areas, three lateral walls and the bottom or corresponding guide elements of the pan, whereby two of these lateral walls are oriented parallel to the longitudinal direction. A cover sealing surface is provided in the slide cover and rests upon the pan sealing surface when the container is closed. This invention provides a container for film-like or sheet-like materials, which can be repeatedly opened and ensures a high sealing function with regard to gases, moisture and aromas while having a simple design.

8 Claims, 4 Drawing Sheets

U.S. PATENT DOCUMENTS

| | | | | |
|---|---|---|---|---|
| 5,080,222 | A * | 1/1992 | McNary | 206/1.5 |
| 5,375,698 | A * | 12/1994 | Ewart et al. | 206/5.1 |
| 5,878,887 | A * | 3/1999 | Parker et al. | 206/528 |
| 6,672,471 | B2 * | 1/2004 | Cross | 220/345.4 |

FOREIGN PATENT DOCUMENTS

| | | |
|---|---|---|
| DE | 1 964 165 | 7/1967 |
| DE | 2 224 236 | 11/1973 |
| DE | 7125676 | 2/1974 |
| DE | 2812052 C2 | 10/1978 |
| EP | WO 99/23003 | 5/1999 |
| EP | WO 00/30956 | 6/2000 |
| JP | 5-22380 | 3/1993 |

* cited by examiner

CONTAINER COMPRISING A SLIDE COVER

DESCRIPTION

The invention relates to a container for storing and making available stacked foil-like or sheet-like materials consisting of a tray receiving the stacked materials with a bottom and closed side walls adjoining the bottom and a cover which surrounds this tray at least partly and closes it tightly.

Such a container is known from Japanese Utility Model Application 5-22380. The cover, which grips firmly around the tray, has a flap attached to it by means of a film hinge for the individual removal of the foil-like or sheet-like materials. The flap, which extends over an entire side edge of the container and tapers toward the container center, lies on the cover and on the tray via a complicated sealing surface which is curved several times. The sealing contour requires complex mold-making and is moreover prone to leakage.

The present invention is therefore based on the problem of providing a repeatedly openable container for foil-like or sheet-like materials which, while having a simple construction, guarantees a highly effective sealing function with regard to gases, moisture and aromas.

This problem is solved by the features of the main claim. To this end, the cover is designed as a slide cover. The tray and the slide cover each have on both sides, parallel to their longitudinal direction, mutually parallel guide elements. All side walls of the tray have, facing the slide cover, a closed tray sealing surface surrounding the tray opening. The slide cover grips around at least partly or in regions three side walls and the bottom or corresponding guide elements of the tray, two of these side walls being oriented parallel to the longitudinal direction. A cover sealing surface, which lies on the tray sealing surface when the container is closed, is designed in the slide cover.

This container is a flat sliding box, the slide cover of which is moved relative to the tray, for example captively, to open the container. The slide cover and the tray lie on one another via a simply yet accurately manufacturable sealing join for maximum possible aroma protection.

Further details of the invention emerge from the subclaims and the description below of some diagrammatically represented illustrative embodiments.

BRIEF DESCRIPTION OF THE DRAWINGS

FIGS. 1–11 show a number of sections and views of in part different, small and light containers for storing and making available stacked foil-like or sheet-like materials (1). The latter—also referred to as wafers—are in each case illustrated only as a stack block in the figures. The stack block (1) has an area of roughly 1*1⅓, for example. The height is roughly 5 mm.

Figure 1:
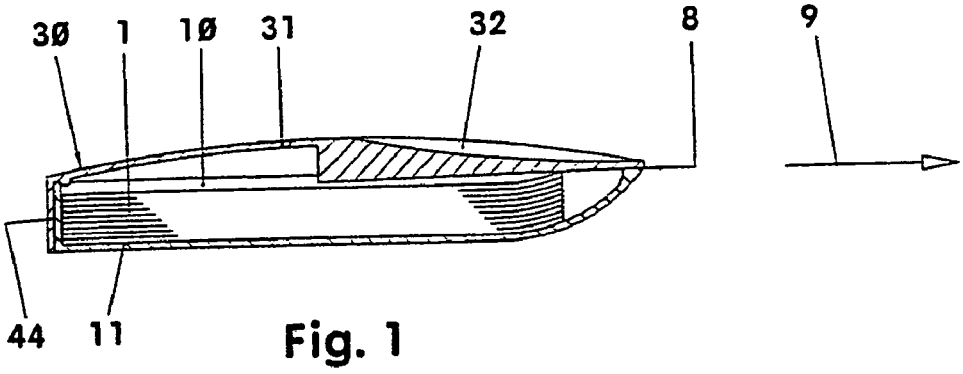
FIG. 1: closed container in longitudinal section.

The container width is roughly 73% of the container length, while the container height is roughly 18% of the container length.

FIGS. 1–5 show a first container variant. The container consists of a tray (10) and a slide cover (30). In the closed state, the tray (10) and the slide cover (30) enclose the stack block (1) in a gastight, moisturetight and aromatight way. The height of the tray (10) corresponds to roughly 12% of the container length.

The tray (10) has a bottom (11) and three side walls (12–14) adjoining the bottom at least approximately perpendicularly. A fourth side wall, what is known as the front wall (15), is designed in a curved shape as a removal lip, the curvature being, for example, part of a cylinder wall. In this connection, the front wall (15) originates tangentially from the bottom (11). The radius of curvature corresponds to roughly 30% of the container length. Owing to the flat rise of this side wall (15), the individual wafers can easily be pushed or pulled out of the tray (10), for example with the aid of a fingertip.

All side walls (12–15) end toward the top in a, for example, plane tray sealing surface (18). In the illustrative embodiment, this surface is aligned parallel to the bottom (11), cf. FIG. 5 also. The upper edge width of the side walls (12–14) is approximately the same width in the region of the tray sealing surface (18). The upper edge of the front wall (15) has roughly twice the edge width. The edge transition from the internal contour of the curved front wall (15) to the sealing surface (18) is rounded here.

In the bottom region, the two parallel side walls (12, 13) have mirror-symmetrical guide grooves (21) which comprise a 45° incline (24) and a vertical surface (25). The guide grooves (21) extend over the entire length of the tray.

The slide cover (30) consists of an arched cover part (31) and three side walls (42–44) adjoining this part, which are largely plane at least in the tray region. When the container is closed, the side walls (42–44) bear against the outside of the corresponding side walls (12–14) of the tray (10) at least in regions. The overall arching of the cover part (31) constitutes, for example, a lateral portion of a cylinder, the center line of which lies transversely to the longitudinal direction (9) and parallel to the bottom (11) below the tray (10). The arching can also be part of an ellipsoid or of another curved three-dimensional surface. The radius of the curvature of the illustrative embodiment is roughly 260% of the container length. In, for example, the front half of the cover part (31), a gripping recess (32) is let in. Here, the latter has approximately the shape of a spherical depression, the mean radius of which is roughly 250% of the container length. The gripping recess (32) can be knurled, knobbed, roughened or provided with other surface textures on the outer side of the slide cover.

Figure 2:
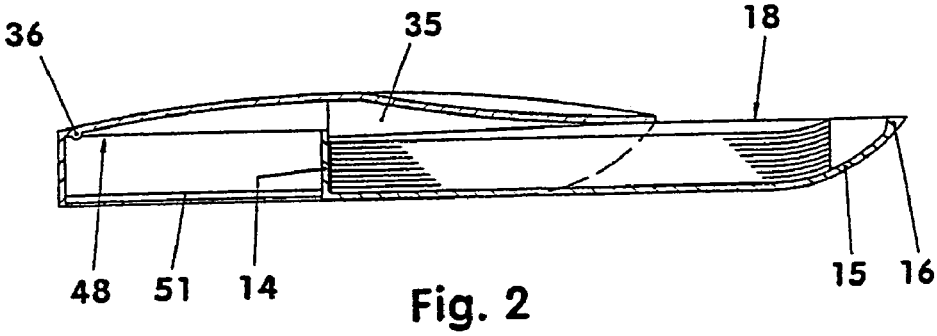
FIG. 2: open container in longitudinal section.
Figure 3:
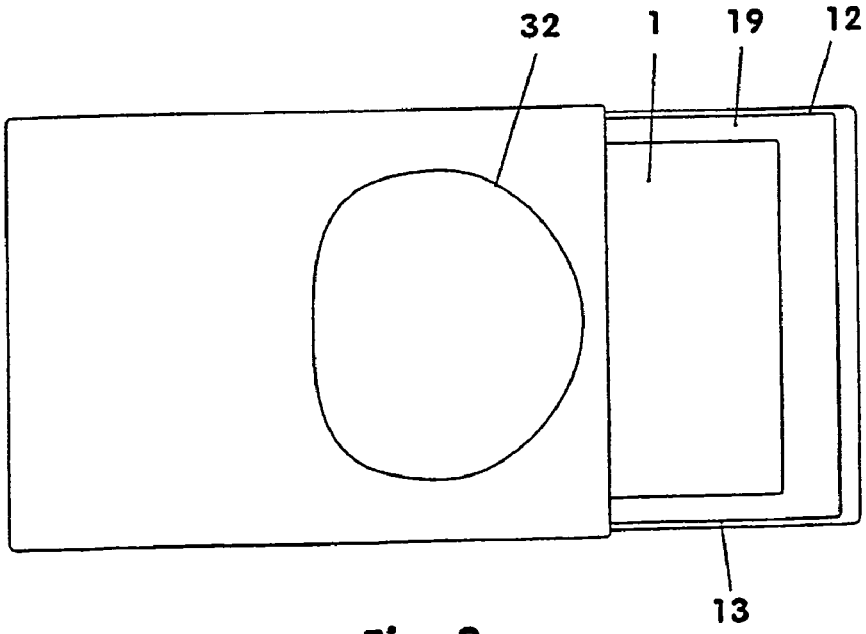
FIG. 3: open container in the top view.
Figure 4:
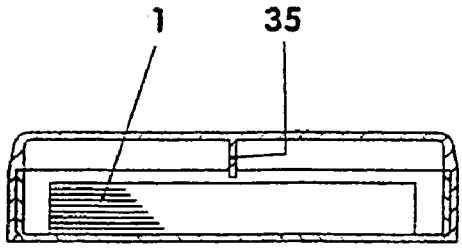
FIG. 4: central container cross section looking toward the rear.

Located on the inner side of the slide cover (30) is inter alia a stop web (35), cf. FIGS. 1, 2 and 4. It prevents the tray (10) being removed completely from the slide cover (30) when the container is opened. In longitudinal section, cf. FIG. 1, the stop web (35) has the shape of a triangle, the vertex of which lies in the region of the front edge of the slide cover (30). The lower edge of the stop web (35) descends so far toward the cover center that it projects below the, tray sealing surface (18) by, for example, the thickness of one tray wall. At maximum opening travel, the rear side wall (14) of the tray (10) comes into contact with the rear edge of the stop web (35), cf. FIG. 2, where an elevation of the stop web (35) is shown.

In the prolongation of the stop web (35) backward, a stop projection (36) which can be passed over is located on the cover part (31) just in front of the rear side wall (14). The projection is offset forward in relation to the side wall (14) by the thickness of the tray wall. Facing the tray (10), it has, for example, a hemispherical contour. According to FIG. 1, the rear tray side wall (14) is gripped between the rear cover side wall (44) and the stop projection (36) when the container is closed. In this way, unintentional opening of the container is prevented. On opening and closing, the tray (10) is pushed over the stop projection (36) with both container parts (10, 30) undergoing elastic deformation.

Figure 5:
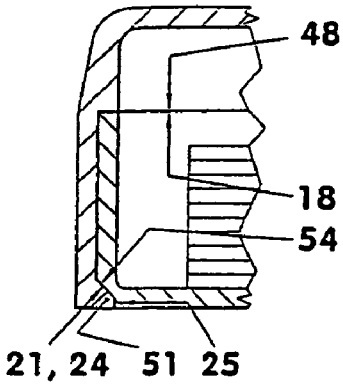
FIG. 5: lateral partial cross section of the container.
Figure 6:
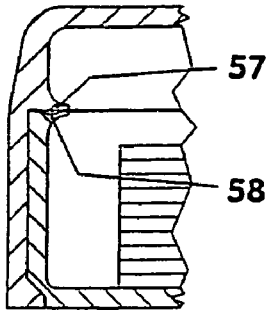
FIG. 6: lateral partial cross section of the container with additional sealing lip.
Figure 7:
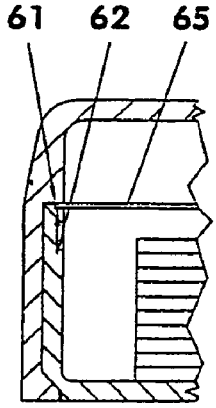
FIG. 7: lateral partial cross section of the container with tray additionally closed by means of a foil seal.

The side walls (42, 43) of the slide cover (30) surround the side walls (12, 13) of the tray (10) in a c-shape, cf. FIGS. 5–7. Above the tray sealing surface (18), they are—forming a plane cover sealing surface (48) when the container is closed—widened inward so far, according to FIG. 5, that they cover the tray sealing surface (18). This widening is located at the rear side wall (44), cf. FIGS. 1, 2, 10 and 11. The front edge of the slide cover (30) is also shaped as part of the cover sealing surface (48) in the region of the tray front edge.

At their lower edges, the side walls (42, 43) have mirror-symmetrical guide webs (51) which in each case bear via a 45° incline (54) against the corresponding guide groove (21) of the tray (10).

The container parts (10, 30) are made of an elastic plastic, which is preshaped in such a way that the side walls (42, 43) of the slide cover (30) bear against the tray side walls (12, 13) with gripping force. The 45° inclines (24, 54) in mutual contact of the container parts (10, 30) bring about a clamping force which presses the cover sealing surface (48) and the tray sealing surface (18) onto one another, forming a sealing join (8).

Figure 12:
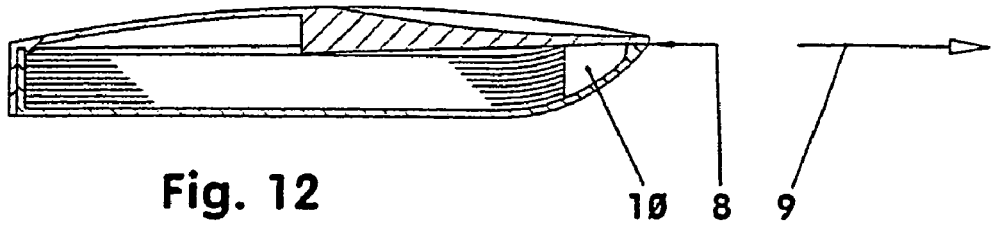
FIG. 12: closed container in longitudinal section with sealing join running at an angle in relation to the container.
Figure 13:
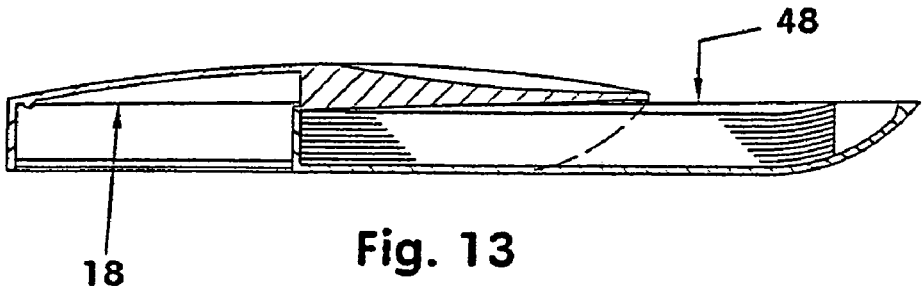
FIG. 13: open container from FIG. 12.

If appropriate, the plane of the sealing join (8) can form an acute angle with the longitudinal direction (9), cf. FIGS. 12 and 13, the tray (10, 110) having a smaller sealing height at the rear than at the front. In this case, the sealing surfaces (18, 48) come up against one another only over the final millimeters of the container closing movement, which reduces the frictional loading of the sealing surfaces (18, 48). This makes thin, friction-capable and sealing coatings of the sealing surfaces possible.

The front edge of the slide cover (30) is shaped in such a way that, when the container is open, it is arched downward slightly, transversely to the longitudinal direction (9). During closing of the container, the slide cover front edge slides onto the tray front edge, bringing about a sealing force.

FIG. 6 shows a sealing join (8) with lip seals. To this end, inwardly protruding projections forming sealing lips (57, 58) are arranged on the side walls (12–14; 42–44) of the container parts (10, 30). In the illustrative embodiment, the upper sealing lips (57) are rigid, while the lower sealing lips (58) are elastic and press against the upper lips.

Figure 9:
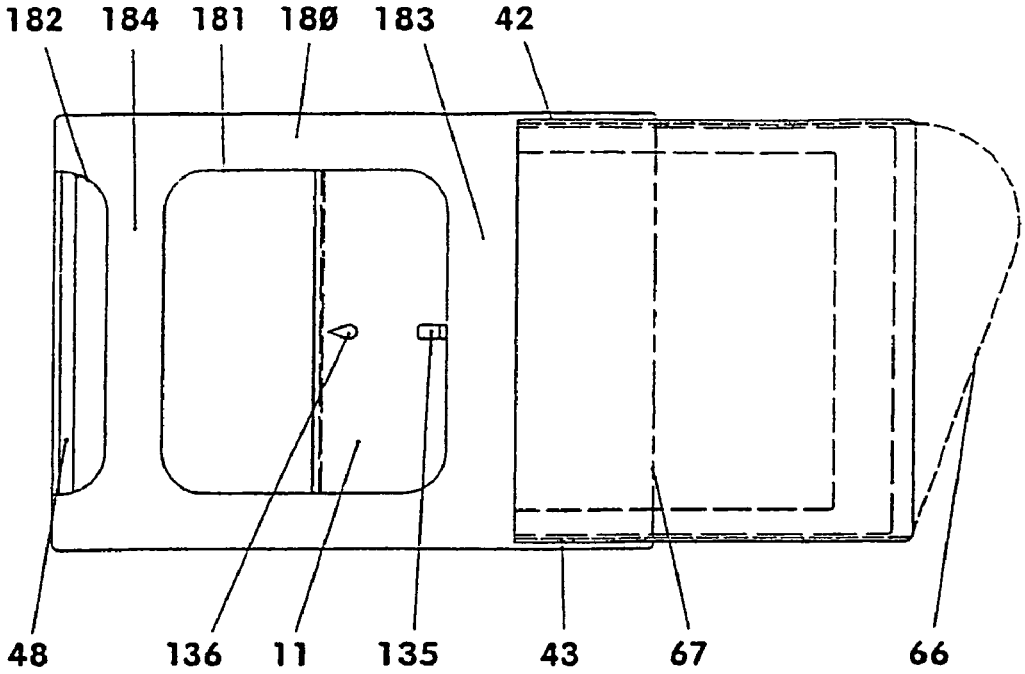
FIG. 9: open container with all-round slide cover in the view from underneath.
Figure 10:
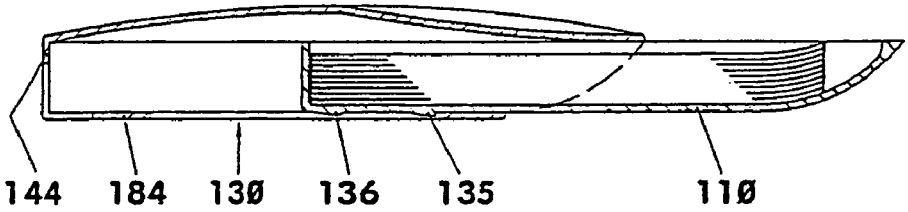
FIG. 10: open container with all-round slide cover in longitudinal section.
Figure 11:
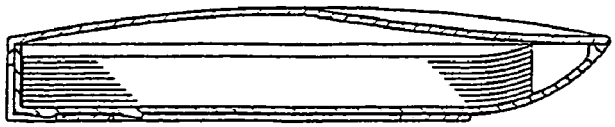
FIG. 11: closed container according to FIG. 10.

FIGS. 9–11 show a container variant, the slide cover (130) of which grips around the tray (110) in parts and the container cross section completely—as in the case of a conventional matchbox—by means of a cover bottom (180). The cover bottom (180) extends from the rear side wall (144) forward to the front end of the tray bottom (11). By using the cover bottom (180), the functions of the separate guide elements. (21, 51) of the container variant described previously are replaced by the side walls (12, 13; 42, 43) and the cover bottom (180).

Located in the cover bottom (180) are, for example, two cutouts (181, 182), which divide the cover bottom (180) into two bottom webs (183, 184). The rear cutout (182) continues a long way into the side wall (144), cf. FIG. 10. Both cutouts (181, 182) have a rectangular contour here. Other contours are likewise conceivable.

Formed on the tray bottom (11) are a rear stop projection (136) and a front stop web (135). The front stop web (135) prevents the tray (110) being removed completely from the slide cover (130). To this end, the stop web (135) comes up against the front bottom web (183) in a locking manner, cf. the locking function of the stop web (35). In longitudinal section, the stop web (135) has largely a triangular contour, cf. FIGS. 10 and 11. The vertex of the triangle is oriented toward the rear. Consequently, when initial assembly takes place, the tray (110) can be pushed into the slide cover (130) with both container parts (110, 130) undergoing elastic deformation. The rear stop projection (136), which has the function of a stop for keeping the container closed, bears against the rear edge of the rear bottom web (184) when the container is closed. In longitudinal section, cf. FIGS. 10 and 11, it is rounded at the front and the rear, being sloped toward the rear for easier initial assembly. The slope is shown in a drop contour in the view from underneath according to FIG. 9.

The containers from FIGS. 1–5 and 9–11 make possible simple one-hand operation. To this end, the container is taken hold of between the index finger and the thumb. The rear side wall of the slide cover (30) faces the inside of the hand. The thumb rests on the gripping recess (32). The tray (10) rests on the slightly bent index finger. If then—with the container held firmly—the thumb is drawn backward away from the index finger, the slide cover (30) is moved back as far as the opening stop (35). Then, with the tip of the thumb—without changing the basic position of the hand—the top sheet of the stack block (1) can be pushed over the front edge of the tray (10) so as—after a corresponding arm movement—to be taken over with the tongue.

To close the container, the basic position of the hand is maintained, and the thumb is pushed forward over the bent index finger until the stop (36) for keeping the container closed catches. The container is closed in an aromatight manner again.

The container with the slide cover (130) which has the cover bottom (180) is held between the thumb and the index fingertip or the index finger end. The index fingertip grips the tray (110) through the cutout (181).

Figure 8:
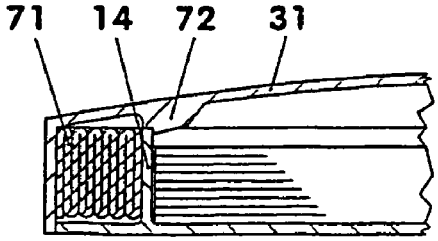
FIG. 8: partial longitudinal section of the container with opening spring.

The opening movement can be supported with the aid of a spring (71), cf. FIG. 8. To this end, a bending spring (71) folded several times is arranged in the rear region of the tray (10). When the container is closed, the bending spring (71) is surrounded by the backwardly extended side walls (12, 13) and the likewise extended bottom (11). It is, for example, glued to the outside of the rear side wall (14). Located in the cover part (31), in front of the rear side wall (14), is a catch stop (72) which, by an upward movement, allows the spring-supported opening travel. To this end, the lateral cover side walls (42, 43) are deformed elastically by manual force in such a way that the cover part (31) arches upward slightly.

FIG. 7 shows a variant solution, with the aid of which what is known as a secondary packaging can be forgone. To this end, for arranging a foil seal (65) in the tray (10), a lower-lying shoulder (61) running all around is arranged in the region of the tray sealing surface (18). The maximum height of the shoulder (61) is a few tenths of a millimeter. The width of the shoulder corresponds to roughly half the wall thickness of the side walls (12–14).

The foil seal (65) is fastened, sealing the tray (10) completely, on a, for example, plane sealing surface (62) of the shoulder (61). In FIG. 9, the foil seal (65) is illustrated—from below—by dash/dot lines. It extends with a tear-off tab (66), asymmetrically for example, beyond the front edge of the tray (10, 110). The foil seal (65) additionally has a stamped tear-off impression (67). This is drawn in FIG. 9 with a dash/double dot line and lies directly in front of the front edge of the slide cover (30, 130) when the container is open. When the foil seal (65) held by the tear-off tab (66) is removed, the seal tears off completely at the tear-off impression (67).

In every case, at least the tray (10, 110) is made of an injection-moldable material which hardly absorbs aromas, for example of essential oils, for example polypropylene, polyethylene naphthalene, polyethylene terephthalate or comparable materials. If appropriate, the material can be coated with, for example, $SiO_x$, at least on the inside of the container, in order to guarantee a high degree of aromatightness. The foil seal (65) is made of, for example, aluminum-coated polyvinyl chloride, polyvinylidene dichloride or comparable materials.

Figure 14:
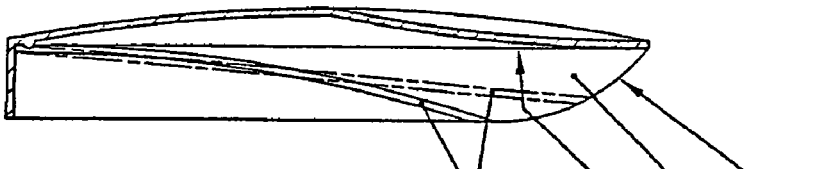
FIG. 14: slide cover in longitudinal section with curved tray guide.
Figure 15:
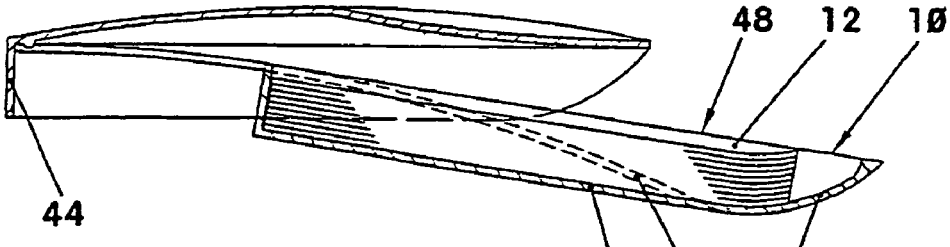
FIG. 15: open container from FIG. 14.

FIGS. 14 and 15 show a slide cover (10) and a container in which curved or inclined guide elements (21, 51) are arranged in the side walls (12, 13; 42, 43). For example, the slide cover walls (42, 43) bear a projecting guide profile, while the tray side walls (12, 13) have corresponding guide grooves. In this container, the cover sealing surface (48) is arranged parallel to the bottom (11), as it is in the container in FIGS. 1–3 as well.

In the case of the straight guide elements aligned at an angle to the cover sealing surface (48), which are illustrated as dash/dot lines in FIG. 14, the sealing surfaces (18) and (48) move away from one another proportionally during opening travel. In this connection, the sealing surfaces (18) and (48) move parallel to one another. The actuating force necessary for opening the containers according to FIGS. 12–15 is, after overcoming the breakaway force of the initial millimeters of the opening travel, considerably smaller than in the case of the containers according to FIGS. 1–11 owing to the sealing surface friction ceasing.

In the case of the curved guide elements (21, 51), the tray (10) moves on, for example, a circular path in relation to the slide cover (30). The center of the circular path lies in the prolongation of the internal contour of the side wall (44) below the slide cover (30). The radius of the circular path corresponds to, for example, roughly 250% of the container length, so that the front end of the guide elements (21, 51)—related to the tray (10)—ends at the transition between the bottom (11) and the front side wall (15). The stops for the opening travel are arranged in the guide elements (21, 51).

The curvature of the guide elements (21, 51) affords convenient accessibility of the tray contents (1) after the container has been opened.

LIST OF REFERENCE NUMBERS

1 foil-like or sheet-like material, wafers, stack block, tray contents
8 sealing join
9 longitudinal direction, sliding direction
10, 110 tray, container part
11 bottom, tray bottom
12, 13 side walls, right, left
14 side wall, rear
15 side wall, front; front wall
16 front edge of the tray, removal lip
18 tray sealing surface
19 tray opening
21 guide elements, guide grooves
24 45° incline
25 vertical surface
30, 130 lid, slide cover, container part
31 lid part
32 gripping recess
35, 135 stop web, opening stop
36, 136 stop projection, stop for keeping container closed
42, 43 side walls, lateral
44, 144 side wall, rear
48 lid sealing surface
51 guide elements, guide webs.
54 45° incline
57, 58 sealing lips; top, bottom
61 shoulder
62 sealing surface
65 foil seal
66 tear-off tab
67 tear-off impression
71 bending spring
72 catch stop
180 lid bottom
181, 182 cutouts, front, rear
183, 184 bottom web, front, rear

The invention claimed is:

1. A container for storing and making available stacked foil or sheet materials (1) consisting of a tray (10, 110) having an internal region receiving the stacked materials (1) with a bottom (11) and closed side walls (12–15) adjoining the bottom and a slide cover (30, 130) which surrounds the tray (10, 110) at least partly and closes it tightly, wherein the tray (10, 110) and the slide cover (30, 130) each have on both sides, parallel to their longitudinal direction (9), mutually parallel guide elements (21) and (51), the side walls (12–15) of the tray (10, 110) have, facing the slide cover (30, 130), a closed tray sealing surface (18) surrounding a tray opening (19), the front side wall (15) oriented in a sliding direction (9) to the front being a removal lip having a curved shape, the slide cover (30, 130) grips around at least, partly or in regions, three side walls (12–14) of the tray (10, 110) and the bottom (11) or corresponding guide elements (21), the two side walls (12, 13) being oriented parallel to the longitudinal direction (9), the slide cover (30, 130) being arched upward away from the tray (10, 110) and bearing on its inner side a stop web (35), the lower edge of which, from the front edge of the slide cover (30, 130) as far as the cover center, descends, forming a stop, to below the tray sealing surface (18), and a cover sealing surface (48), which lies on the tray sealing surface (18) when the container is closed, is designed in the slide cover (30, 130).

2. The container as claimed in claim 1, characterized in that at least two fifths of the tray opening (19) are exposed when the container is completely open.

3. The container as claimed in claim 1, characterized in that, for receiving the stacked foil or sheet materials (1), the internal region of the tray (10, 110) has a rectangular shape at least in the plane of the stacked foil or sheet materials (1).

4. The container as claimed in claim 1, characterized in that a sealing join (8) formed by the tray sealing surface (18) and the cover sealing surface (48) lies in a plane.

5. The container as claimed in claim 1, characterized in that a sealing join (8) is arranged parallel to the bottom (11) of the tray (10, 110).

6. The container as claimed in claim 1, characterized in that an arching constitutes a lateral portion of a cylinder, wherein the center line of the cylinder lies transversely to the longitudinal direction and parallel to the bottom (11) below the tray (10).

7. The container as claimed in claim 1 or 6, characterized in that a gripping recess (32) is integrated in an arching of the slide cover (30, 130).

8. The container as claimed in claim 1, characterized in that a shoulder (61) running all around is designed between the tray opening (19) and the tray sealing surface (18), on the shoulder a foil seal (65) which closes the tray (10, 110) once is fixed.

* * * * *